United States Patent [19]

Parekh et al.

[11] Patent Number: 4,589,233

[45] Date of Patent: May 20, 1986

[54] SECTIONAL ABRASIVE BELT

[75] Inventors: Dhan N. Parekh, Williamsville; David E. Williams, North Tonawanda, both of N.Y.

[73] Assignee: Carborundum Abrasives Company, Niagara Falls, N.Y.

[21] Appl. No.: 623,956

[22] Filed: Jun. 25, 1984

[51] Int. Cl.[4] ..... B24D 11/02; B24D 11/06

[52] U.S. Cl. ..... 51/399; 51/400; 51/404; 156/137; 474/267

[58] Field of Search ..... 51/394, 399, 400, 404, 51/397, 401, 407; 156/137; 428/112; 474/253, 254, 262, 266, 267; 198/846, 847

[56] References Cited

U.S. PATENT DOCUMENTS

| | | | |
|---|---|---|---|
| 921,415 | 5/1909 | Langford | 474/266 |
| 2,209,059 | 7/1940 | Kirchner | 51/399 |
| 3,053,020 | 9/1962 | Bratton | 51/399 |
| 3,637,359 | 1/1972 | Malloy | 51/399 X |
| 3,759,112 | 9/1973 | Polshikov et al. | 474/267 X |
| 3,787,273 | 1/1974 | Okrepkie et al. | 51/407 X |
| 4,215,516 | 8/1980 | Huschle et al. | 51/399 |

*Primary Examiner*—Robert P. Olszewski

*Attorney, Agent, or Firm*—Donald C. Studley; Michael L. Dunn

[57] ABSTRACT

A sectional cloth backed abrasive belt comprising a series of abrasive coated cloth backed sections joined together so that the joints between sections are at an angle of from about 45°, to about 85° to the running direction of the belt. The cloth backing has at least a portion of the fill filaments of the cloth backing at an angle of from 45° to 85° to the warp filaments of the cloth backing and the sections are joined such that at least 30% of the fill filaments are disposed in the running direction of the belt. The invention further comprises the process for making such an abrasive belt by joining appropriate parallelogram shaped sections. The section of abrasive belt of the invention has increased strength in the running direction of the belt and decreased stretch in the running direction of the belt.

14 Claims, 2 Drawing Figures

SECTIONAL ABRASIVE BELT

BACKGROUND OF THE INVENTION (A) Field of the Invention

This invention relates to an improved coated abrasive belt, and more particularly, to an improved sectional coated abrasive belt having a width in excess of fifty inches.

(B) History of the Prior Art

In recent years, many applications have been developed that require the use of coated abrasive belts that have widths in excess of about 50 inches. The manufacture of such wide belts poses a serious problem to the coated abrasive industry. Commonly available equipment is not capable of coating backings that are wider than about 50 inches, and the cost of equipment that would be required to coat wider backings is prohibitive.

Many proposals have been made in the past to manufacture wide belts by splicing together sections of abrasive coated backing material. To make a belt that will operate smoothly, the joints between the sections must be at an angle to the direction of belt travel. To make the joint, the layer of abrasive is usually removed, and in some cases the abrasive is ground off both the bottom and top laps of two sections that are to be joined. Adhesive is then applied to the ends where the segments are to be joined, and the two ends are brought together in alignment between the platens of a press. The adhesive is then cured commonly under pressure.

In making such joints, it is difficult to obtain perfect alignment of the laps, and it is not unusual to obtain a joint that has a greater thickness than the abrasive coated backing, so that the belt has a tendency to bump in use. This produces undesirable finishing and grinding results, and accelerates belt wear on and in the vicinity of the splice area.

To minimize the effects of variations in belt thickness, it is common to dispose the joints at an angle to the running direction of the belt. One common technique for making wide, sectional belts involves cutting a coated abrasive web into a series of parallelograms, and joining these parallelograms along their longer sides. The belt that is thus obtained has the warp threads of the sections disposed at an angle to the running direction of the belt. Usually this angle is in excess of 45°, so that the strength and stretch of the belt are determined in large part by the cross tensile strength and cross stretch, respectively, of the backing of which the sections are made. In most cases, when standard finished drills or jeans cloth is used, these characteristics fall considerably short of what industry desires and needs. It is understood that warp filaments are those which run lengthwise in the loom or other clothmaking apparatus. Weft or fill filaments are those which run crosswise in the loom. "Filaments" as used herein is intended to cover threads, yarn, monofilament fibers or combinations of such fibers. Such filaments may be natural or synthetic. trapezoidal, abrasive coated segments together so that their warp threads always extend in the running direction of the belt. While this produces a belt whose tensile strength and stretch characteristics are more susceptible of control, there are many places along the length of the belt where three segments come together in a joint, and it is very difficult to form these joints with the same thickness as the remainder of the belt. Furthermore, because of the larger number of segments that must be joined together to make such a belt, labor costs are quite high.

To minimize conditions making for stretch in the cross direction, essentially the running direction in a sectional belt, it has been proposed to provide a backing member of sateen construction and to employ a minimum of tension in the warp direction during cloth finishing, see e.g. U.S. Pat. No. 3,053,020. Moreover, in a preferred proposal a sateen weave cloth backing member is selected and finished so that it is characterized by having practically equivalent strength and stretch in both the warp and fill (cross) directions. A finishing method to reduce stretch and improve strength in the running direction is also disclosed in U.S. Pat. No. 3,787,273. Nevertheless, while such fabric constructions and finishing conditions have resulted in some improvement in sectional abrasive belts, the search has continued for even further improvement in the stretch characteristics of such wide belts.

DESCRIPTION OF THE INVENTION

In accordance with the invention there is provided a sectional cloth backed abrasive belt comprising a series of abrasive coated cloth backed sections joined together. The joints between the sections are at an angle of from about 45° to about 85° to the running direction of the belt. The cloth backing has at least a portion of the fill filaments of the cloth backing at an angle of from 45° to 85° to the warp filaments of the cloth backing. The sections are joined such that at least 30% and preferably at least 50% of the fill filaments are disposed in the running direction of the belt. The invention further comprises a process for making a sectional cloth backed abrasive belt as previously described by joining a series of abrasive coated cloth backed sections so that the joints between the sections are at an angle of from about 45° to about 85° to the running direction of the belt.

As a result of at least 30% of the fill filaments being disposed in the running direction of the belt, such fill filaments take up the stress of the belts thus reducing belt stretch to the natural stretch of the fiber. The stretch of the belt is no longer dependent upon the tightness of the weave as was the case in the prior art. Furthermore, the tensile strength of the belt is substantially improved since in order for the belt to break, either the joint has to be broken or the fill filaments have to be broken along their longitudinal length. Furthermore, since fill filaments are joined together at their ends in the joints, the joints are substantially stronger. This is made possible since the fill filaments are disposed at an angle to the warp filaments of the cloth backing so that sections can be cut so that the wrap filaments can be at an angle of from about 45° to about 85° to the running direction of the belt while still permitting the fill filaments to be aligned in the running direction of the belt.

Preferably, the joints between the sections of the sectional belt are at an angle of from about 75° to 85° to the running direction of the belt, and the fill filaments are preferably at an angle of from about 75° to 85° to the warp filaments. Desirably, the angle of the joints to the running direction of the belt is essentially the same as the angle of the warp filaments to the running direction of the belt. The cloth backing may be any suitable cloth, such as a woven cloth, e.g. sateen cloth, wherein the fill or weft filaments are at an angle of from 45° to 85° to the warp filaments. The clock backing may also, for example, be a knitted or stitch-bonded cloth wherein at least a portion of the fill filaments are disposed in the running direction of the belt and cross the warp filaments which are not disposed in the running direction of the belt. Such a cloth backing may comprise an array of warp filaments that extend generally parallel to each other in a first plane; an array of fill filaments that extend generally parallel to one another in a second plane adjacent and parallel to the first plane wherein the filaments extend generally transversely of the warp filaments; and a stitching filament network joining the array of the warp filaments and the array of the fill filaments to one another. Such knitted type backings have some advantages since the warp and fill filaments are essentially straight. Crimping and bending is not present as in conventional woven fabrics. Crimping and bending in conventional fabric reduced fiber strength at the bend and increased stretching.

The joints in the sectional belt are desirably made on the face of the cloth having the most exposed surface of the fill filaments disposed in the running direction of the cloth. This is especially true, for example, when the cloth is a knitted cloth backing having an array of fill filaments extending generally transversely of the warp filaments and stitched to the warp filaments as previously described.

As previously discussed, the filaments may be of any suitable material such as cotton or polyester and may be monofilament material or may be combinations of filaments in the form of threads or yarn.

The present invention will now be further illustrated by reference to the appended drawings.

Figure 1:
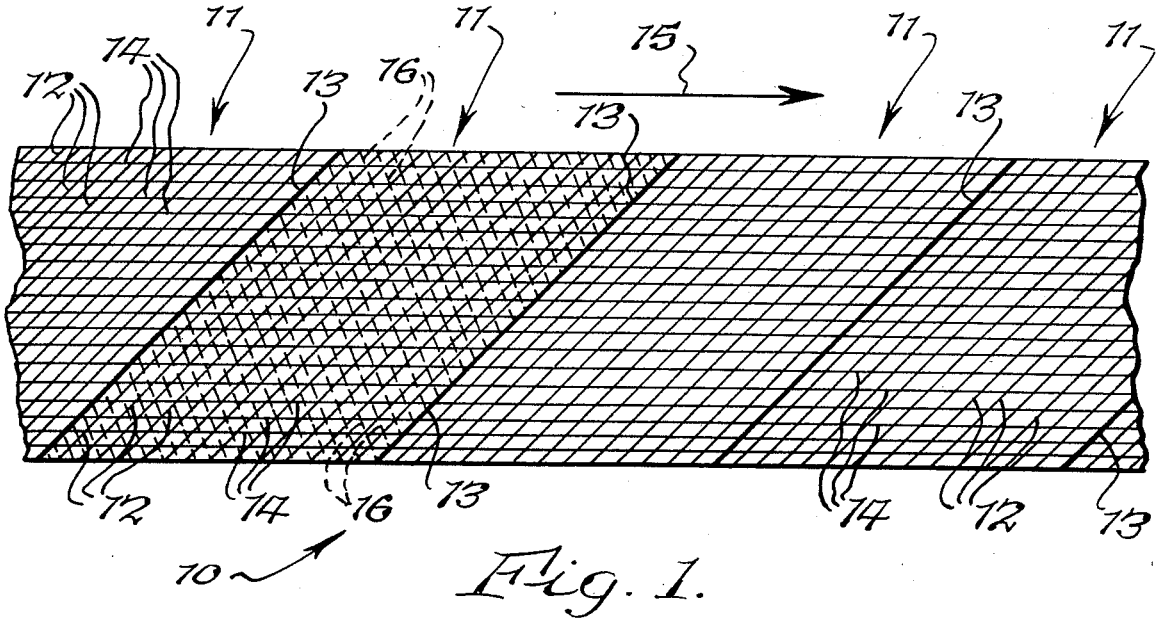
FIG. 1 shows a top view of sections of cloth backing used in the cloth backed abrasive belt of the present invention aligned as they would be in such an abrasive belt.

As shown in FIG. 1 sections 11 of cloth backing 10 are aligned such that warp threads 12 are aligned so that they are parallel with joints 13 between sections 11. Fill threads 14 cross warp threads 12 preferably at an angle of from about 75° to 85° and most preferably at an angle of about 80°. Fill threads 14 are thus aligned parallel to the running direction 15 of an abrasive belt made from such joined cloth sections which have been coated with abrasive. Especially when cloth backing 10 is a knitted cloth, fill threads 14 lie in a plane overlaying the plane of warp threads 12. Fill threads 14 are therefore exposed on one side of cloth backing 10 which in the case of FIG. 1 is the upper surface. When the cloth is a knitted cloth, generally stitching filaments 16 are provided to hold the layers of warp threads 12 and fill threads 14 together. When fill threads 14 are exposed more on one surface than the other, the joint between sections 11 is generally made on the surface having the most fill threads exposed which are aligned in the direction 15 of the belt. In this way, the joint strongly engages fill filaments 14 thus increasing the strength of the belt.

Figure 2:
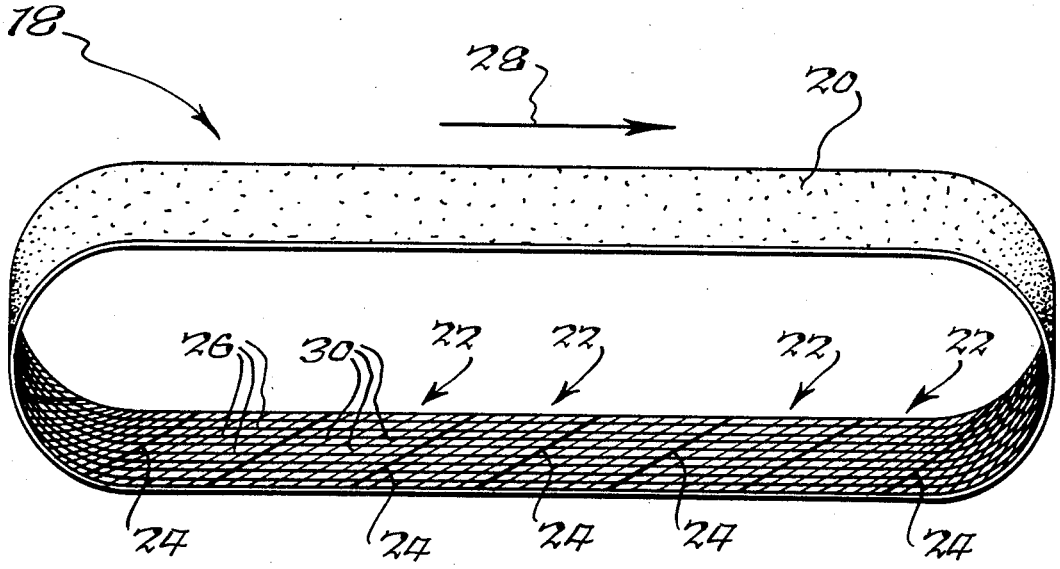
FIG. 2 is a perspective view of a finished belt in accord with the present invention.

FIG. 2 shows a perspective view of a finished belt 18 in accordance with the present invention having a coated abrasive surface 20. As can be seen from FIG. 2, a series of abrasive coated cloth backed sections 22 are joined at joints 24. The fill threads 26 are aligned with the running direction 28 of the abrasive belt and the warp threads 30 cross fill threads 26 at an angle of from about 75° to 85°.

In general, to make a sectional abrasive belt in accordance with the present invention, coated abrasive material is withdrawn from a roll then cut into sections that have the shape of parallelograms as shown in FIG. 1, whose longer side is equivalent to the width of the wide sectional belt desired. The longer side of the sections are then joined with an adhesive bond that is cured under heat and pressure between hot platens to make an endless belt. Preferably, the sections are cut from coated material so that the joint angle is between 45° and 85°. The most preferred angle is between 75° and 82°. Preferably at least 30% of the fill filament are essentially in the running direction of the abrasive belt.

What is claimed is:

1. A sectional cloth backed abrasive belt having a running direction, comprised of a series of abrasive coated cloth backed sections, said sections joined together at angles between about 45° and about 85° to said running direction, the cloth backing of said sections having warp filaments and fill filaments, at least a portion of said fill filaments in said cloth backing positioned at an angle of from 45° to 85° to said warp filaments, said sections being joined such that at least 30% of said fill filaments in said cloth backing are disposed in the running direction of the belt.

2. The belt of claim 1 wherein the joints between sections are at an angle of from 75° to 85° to the running direction of the belt and at least a portion of said fill filaments are at an angle of from about 75° to 85° to the warp filaments.

3. The belt of claim 1 wherein the cloth backing is a sateen cloth.

4. The belt of claim 1 wherein the cloth backing is a knitted cloth and at least a portion of said fill filaments are disposed in the running direction of the belt and cross the warp filaments which are not disposed in the running direction of the belt.

5. The belt of claim 1 wherein the angle of said joints to the running direction of the belt is essentially the same as the angle of the warp filaments to the running direction of the belt.

6. The belt of claim 1 wherein said joints are made on the face of the cloth having the most exposed surface of the fill filaments disposed in the running direction of the belt.

7. The belt of claim 1 wherein the cloth backing comprises:

(i) an array of said warp filaments that extend generally parallel to each other in a first plane;

(ii) an array of said fill filaments that extend generally parallel to one another in a second plane adjacent and parallel to said first plane, the fill filaments extending generally transversely of the warp filaments, and (iii) a stitching filaments network joining said array of warp filaments and said array of fill filaments to one another.

8. In a process for making a sectional cloth backed abrasive belt having a running direction by joining a series of abrasive coated cloth backed sections together at angles between about 45° to about 85° to said running direction, the improvement which comprises using a cloth backing having warp filaments and fill filaments, at least a portion of said fill filaments in said cloth backing, positioned at an angle of from 45° to 85° to said warp filaments and, joining said sections such that at least 30% of said fill filaments in said cloth backing are disposed in the running direction of the belt.

9. The process of claim 8 wherein the joints between sections are at an angle of from 75° to 85° to the running direction of the belt and at least a portion of said fill filaments are at an angle of from about 75° to 85° to the warp filaments.

10. The process of claim 8 whwerein the cloth backing is a sateen cloth.

11. The process of claim 8 wherein the cloth backing is a knitted cloth and at least a portion of said fill filaments are not disposed in the running direction of the belt and cross the warp filaments and the fill filaments which are disposed in the running direction of the belt.

12. The process of claim 8 wherein the angle of said joints to the running direction of the belt is essentially the same as the angle of the warp filaments to the running direction of the belt.

13. The process of claim 8 wherein said joints are made on the face of the cloth having the most exposed surface of the fill filaments disposed in the running direction of the belt.

14. The process of claim 8 wherein the said cloth backing comprises:

(i) an array of said warp filaments that extend generally parallel to each other in a first plane;

(ii) an array of said fill filaments that extend generally parallel to one another in a second plane adjacent and parallel to said first plane, the fill filaments extending generally transversely of the warp filaments, and (iii) a stitching filaments network joining said array of warp filaments and said array of fill filaments to one another.

* * * * *